United States Patent [19]

Boeshart

[11] Patent Number: 4,942,940

[45] Date of Patent: Jul. 24, 1990

[54] SCAFFOLD JACK

[76] Inventor: Patrick E. Boeshart, R.R. 1, Box 134, Sioux City, Iowa 51108

[21] Appl. No.: 219,214

[22] Filed: Jul. 15, 1988

[51] Int. Cl.[5] ..... E04G 1/20; E04G 5/04

[52] U.S. Cl. ..... 182/82; 182/146; 182/229; 248/235

[58] Field of Search ..... 182/146, 145, 150, 229, 182/82; 248/235, 218.4

[56] References Cited

U.S. PATENT DOCUMENTS

| | | | |
|---|---|---|---|
| 295,578 | 3/1884 | O'Brien | 182/229 |
| 459,247 | 9/1891 | Biddall | 182/146 |
| 795,196 | 7/1905 | Conover | 182/146 |
| 1,127,369 | 2/1915 | Nash | 182/229 |
| 3,146,855 | 9/1964 | Aberegg | 182/146 |
| 3,438,460 | 4/1969 | Solari | 182/146 |
| 3,473,774 | 10/1969 | Riblet | 182/146 |
| 4,078,633 | 3/1978 | Fahy | 182/145 |

*Primary Examiner*—Reinaldo P. Machado
*Attorney, Agent, or Firm*—Zarley, McKee, Thomte Voorhees & Sease

[57] ABSTRACT

A scaffold jack includes a jack housing mounted for slidable movement on a vertical post. The jack housing has a support beam projecting horizontally therefrom upon which a working platform is supported above the ground. A ratchet mechanism on the housing includes a pawl which will cooperate with apertures in the vertical post to allow upward movement of the jack housing and support the housing above the ground. A winch is mounted to the jack housing and has a hook and cable connected thereto which may be connected to a bracket journaled in an aperture at the upper end of the post, such that the jack housing may be winched upwardly. A pair of horizontally oriented rigid legs are provided which are connectable to the post and to an adjacent vertical wall structure, such that the post may be stabilized in a vertical orientation.

14 Claims, 5 Drawing Sheets

SCAFFOLD JACK

TECHNICAL FIELD OF THE INVENTION

This invention relates generally to scaffolding used in constructing poured concrete walls and the like, and more particularly to scaffolding which may be selectively raised or lowered adjacent any wall construction.

BACKGROUND OF THE INVENTION

In the construction of poured concrete walls and the like, it is conventional to build scaffolding along the entire wall to allow for finishing of the wall's surface. As the wall progresses upwardly, the scaffolding must follow along in order to allow the finishing work to continue.

One method of raising the top working surface of a scaffold, to follow the construction of the wall, was to erect additional "stories" or "stages" of the scaffold at approximate four to six foot heights. The working surface on top of the scaffold would then be removed and replaced on top of the additional story. The process was typically cumbersome, and the scaffold relied on a series of small diameter posts and cross bracing for strength and rigidity. Unfortunately, the stability of the scaffold decreased as the height increased.

Another method for raising the work surface of a scaffold utilized a scaffold which was attached to a slip-form apparatus, the slip-form being raised continuously by a jack attached to reinforcing rods positioned in the concrete wall being formed. As the slip-form was raised during the pouring of the concrete wall, the scaffold was raised along with the slip-form. However, such apparatus relies on the slip-form type of construction, and requires numerous complicated connections with reinforcing rods placed vertically in the wall to be formed. Such a system is not capable of use on walls which do not use a plurality of vertical reinforcing rods in the wall. Furthermore, such a system requires connection to the wall construction as it is being formed, and does not allow movement independent of the wall construction.

It is therefore a general object of the present invention to provide an improved scaffold jack.

Another object of the present invention is to provide a scaffold jack which is self-supporting away from the wall construction which it serves.

A further object is to provide a scaffold jack which may be raised by a person on the working surface of the scaffold.

These and other objects will be apparent to those skilled in the art.

SUMMARY OF THE INVENTION

The scaffold jack of the present invention includes a jack housing which is mounted for slidable movement on a vertical post. The jack housing has a support beam projecting horizontally therefrom upon which a working platform is supported above the ground. A ratchet mechanism on the housing includes a pawl which will cooperate with apertures in the vertical post to allow upward movement of the jack housing and support the housing above the ground. A winch is mounted to the jack housing and has a hook and cable connected thereto which may be connected to a bracket journaled through an aperture at the upper end of the post. In this way, the jack housing may be winched upwardly by hand. A motorized device may also be added to drive the jack upwardly on the post as desired. A pair of horizontally-oriented rigid legs are provided which are connectable to the post and to an adjacent vertical wall structure, such that the post may be stabilized in its vertical orientation.

DESCRIPTION OF THE PREFERRED EMBODIMENT

Figure 1:
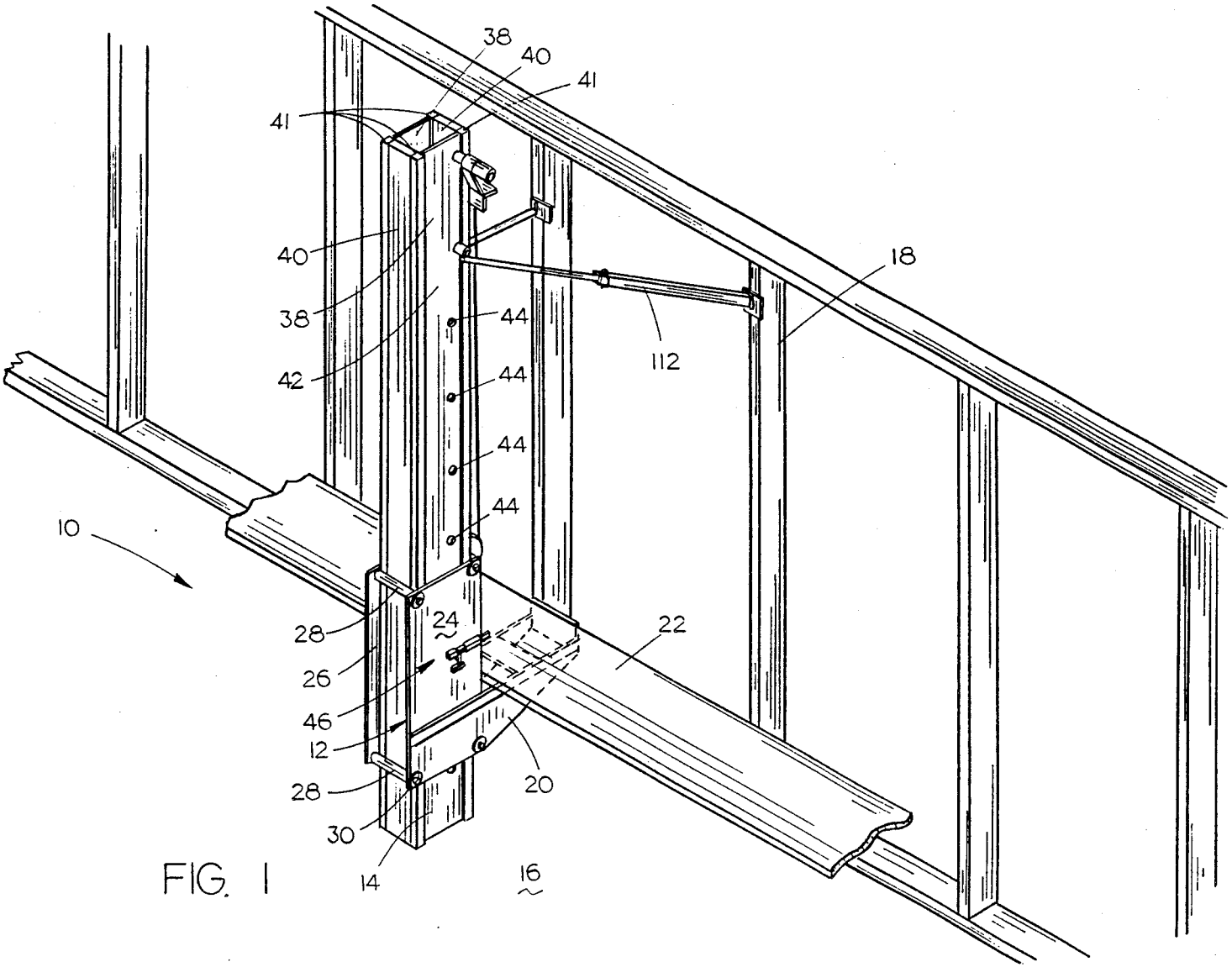
FIG. 1 is a perspective view of the scaffold jack of the invention in operating position on a vertical post.
Figure 2:
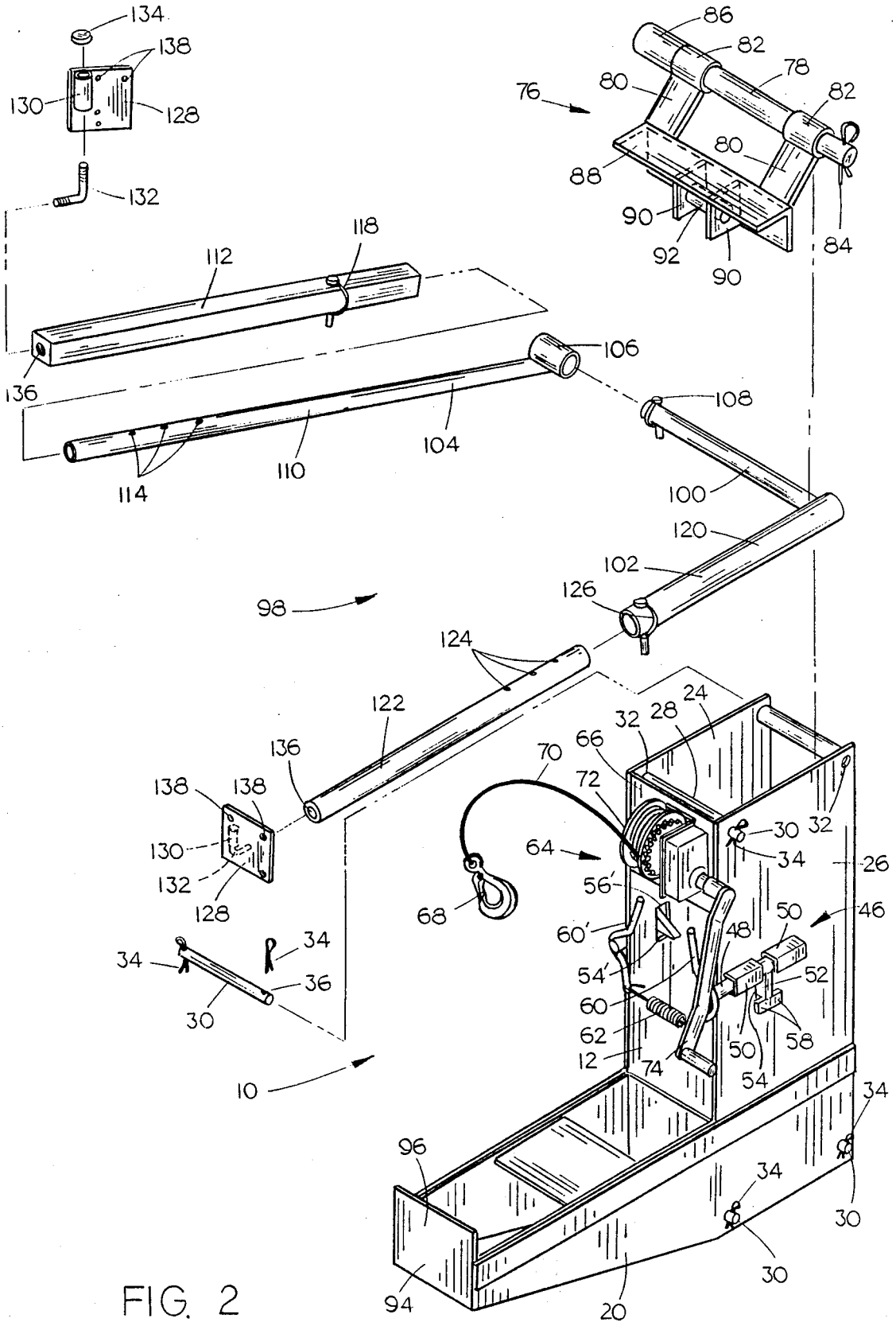
FIG. 2 is an enlarged perspective view of the invention with an upper bracket assembly and a leg assembly shown in relation thereto.

Referring now to the drawings, in which similar or corresponding parts are identified by the same reference numeral, and more particularly to FIG. 1, the scaffold jack of the present invention is designated generally at 10.

Scaffold jack 10 includes a housing 12 which is selectively, slidably connected to a vertical post 14 for movement of jack 10 up and down thereon. Post 14 is supported on the ground 16 adjacent to a wall or framework for a wall 18. A support beam 20 projects horizontally from housing 12, and supports a working platform 22 formed of planks or the like. Scaffold jack 10 may be moved upwardly or downwardly along post 14 in order to raise or lower working platform 22 to allow workers to reach various portions of wall framework 18.

Housing 12 of scaffold jack 10 includes a pair of spaced-apart parallel side plates 24 and 26 which are maintained in their parallel relation by hollow tubular spacers 28 located in each of the four corners of side plates 24 and 26. A pin 30 is journaled through axial apertures 32 in side plates 24 and 26, and through each tubular spacer 28, to connect side plates 24 and 26. A snap clip 34 is snapped through an aperture 36 in each end of pin 30 to retain side plates 24 and 26 on pins 30 with spacers 28 therebetween. It can be seen that spacers 28 also form rotatable bearings, such that post 14 may be movably journaled therebetween to allow easy movement up and down post 14.

Figure 3:
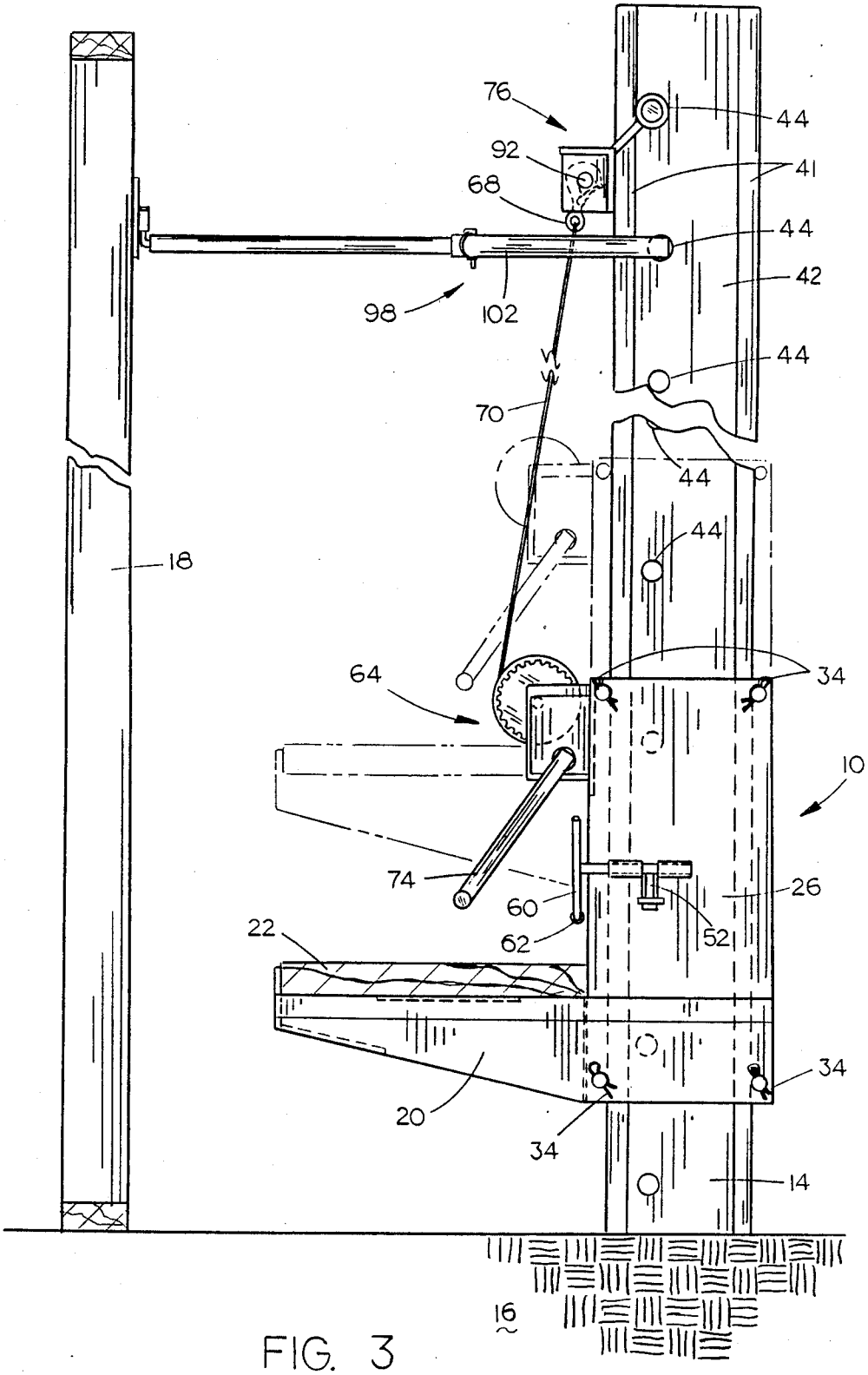
FIG. 3 is a side elevational view of the jack with a broken line view showing the jack being raised to an upper position.

Referring now to FIG. 1, post 14 is formed from a pair of parallel and opposing truss joists 38 which are separated by a pair of parallel and opposing 2×8's 40, or the like. Preferably, joists 38 are built up wooden I-beams having a pair of parallel flange portions 41 separated by a web 42, as shown in FIGS. 1 and 3. The 2×8 spacers 40 are affixed between joists 38 to retain joists 38 in parallel relation. The web 42 of each truss joist 38 has a plurality of vertically aligned and evenly spaced apertures 44 along the entire height of the truss joists 38. Apertures 44 are found in conventional truss joist construction, and are commonly "knockouts" which may be punched out for various uses. A ratchet mechanism 46 mounted on each side plate 24 and 26 of scaffold jack 10 has a pawl 52 which is selectively retained in one of apertures 44 to hold the scaffold jack 10 at the desired height on post 14, as will be described in more detail hereinbelow.

Ratchet mechanism 46 on side plate 26 is identical to ratchet mechanism 46' on side plate 24, and therefore only one mechanism will be described in detail herein. Ratchet mechanism 46 includes a rod 48 rotatably mounted in a pair of spaced-apart sleeves 50 which are affixed to side plate 26 in aligned relationship, as shown in the drawings. A triangular pawl 52 depends from rod 48 with its projecting apex 54 journaled through a rectangular slot 56 in side plate 26. A pair of projecting wings 58 on pawl 52 will contact side plate 26 to prevent pawl 52 from rotating inwardly too far. A rigid arm 60 is affixed to a projecting end of rod 48 and will pivot through a vertical plane perpendicular to rod 48, as rod 48 rotates. Arms 60 and 60' are connected together by a spring 62 so as to bias pawls 52 and 52' to a position with apexes 54 and 54' journaled through slots 56 and 56' and into the interior of jack 10. It can be seen that apexes 54 and 54' will be journaled through apertures 44 in vertical post 14 so as to retain jack 10 in the desired vertical position.

A winch 64 is mounted on a forward plate 66 of housing 12 and includes a snap hook 68 mounted on a cable 70 which is connected to the cable wheel 72 of winch 64. A handle 74 is utilized to rotate cable 72 to lengthen or shorten cable 70.

In order to raise scaffold jack on post 14, snap hook 68 on cable 70 is connected to an upper bracket 76 and jack 10 is then winched upwardly. Upper bracket 76 includes a pin 78 which may be journaled through apertures 44 in truss joists 38. A pair of arms 80 have sleeve portions 82 which may be slipped over pin 78 to make arms 80 rotatable thereon. A snap clip 84 and enlarged head 86 are utilized to retain sleeve portions 82 on pin 78. Arms 80 are connected to a rigid angle 88 having a pair of horizontally spaced-apart plates 90 affixed thereto. A rod 92 is affixed between plates 90 and spaced away from angle 88 such that snap hook 68 may be selectively connected thereto. Thus, jack 10 is winched upwardly on post 14 as it is drawn towards upper bracket 76 by shortening the length of cable 70 using handle 74.

Support beam 20 on jack 10 projects horizontally outwardly from housing 12 and has an end wall 94 projecting upwardly therefrom to form a lip 96. Lip 96 will retain a working platform 22 on support beam 20.

A leg assembly 98 may be connected between vertical post 14 and wall framework 18 to maintain the stability of post 14. Leg assembly 98 is only necessary when post 14 is not capable of having its lower end buried into the ground a sufficient distance to maintain the vertical stability of the post.

Leg assembly 98 includes a pin 100 which is of a size adapted to be journaled through an aperture 44 in truss joists 38. One leg 102 is mounted to one end of pin 100, while an opposite leg 104 is removably mounted on pin 100 such that leg assembly 98 may be connected through post 14 at any desired location. Leg 104 has a sleeve 106 mounted at one end which will receive an end of pin 100 and be retained in place by snap clip 108. Leg 104 includes a rod member 110 projecting from sleeve 106 and is journaled into an elongated sleeve 112 such that the length of leg 104 is adjustable. A series of apertures 114 are located along rod 110 and may be aligned with an aperture 116 in sleeve 112 and selectively fastened by a snap clip 118.

The other leg 102 of leg assembly 98 includes a sleeve 120 affixed to pin 100 and having a rod 122 journaled therein to selectively adjust the length of leg 102. A series of apertures 124 in rod 122 may be aligned with an aperture in sleeve 120 to selectively connect rod 122 to sleeve 120 via snap clip 126.

Each leg 102 and 104 has a plate 128 operably connected to the ends thereof which may be fastened to the wall framework. Each plate 128 has a sleeve 130 affixed thereto which will receive one leg of an angular pin 132. Each leg of angular pin 132 is threaded, one leg being threaded into a threaded aperture 136 in the end of each leg member 102 and 104. In this way, plates 128 may be pivoted to virtually any angle or tilt for a flush abutment with the wall framework to which it will be connected. Several holes 138 in plates 128 allow for nails, woodscrews or the like, to be used to fasten plates 128 to the wall framework. Thus, the upper end of vertical post 14 may be rigidly retained at a specific distance away from wall framework 18 to maintain the vertical stability of post 14.

In operation, when it is desired to locate a scaffold adjacent a wall framework 18 in order to assist in constructing or finishing a wall, a vertical post 14 may be formed from materials already on hand and used in the construction of the building: namely, a pair of truss joists and a pair of dimensional-lumber boards. These are formed into a hollow, vertical post 14 which is located at the desired position, spaced-away from wall framework 18. To form a continuous working platform along the entire wall, a series of such posts would be located along the wall.

In situations where the lower end of post 14 cannot be buried in ground 16, leg assembly 98 is connected near the upper end of vertical post 14 and then connected to wall framework 18 (see FIG. 3). The length of legs 102 and 104 may be adjusted for the desired distance of post 14 from wall framework 18. Upper bracket 76 is then connected through one of apertures 44 near the upper end of vertical post 14 and then jack 10 may be mounted on vertical post 14 by removing spacers 28, locating the jack 10 on post 14, and fastening it into operating position using snap clips 34. Snap hook 68 is then connected to rod 92 on upper bracket 76 and the working platform 22 is laid across support beam 20 on jack 10.

Figure 5:
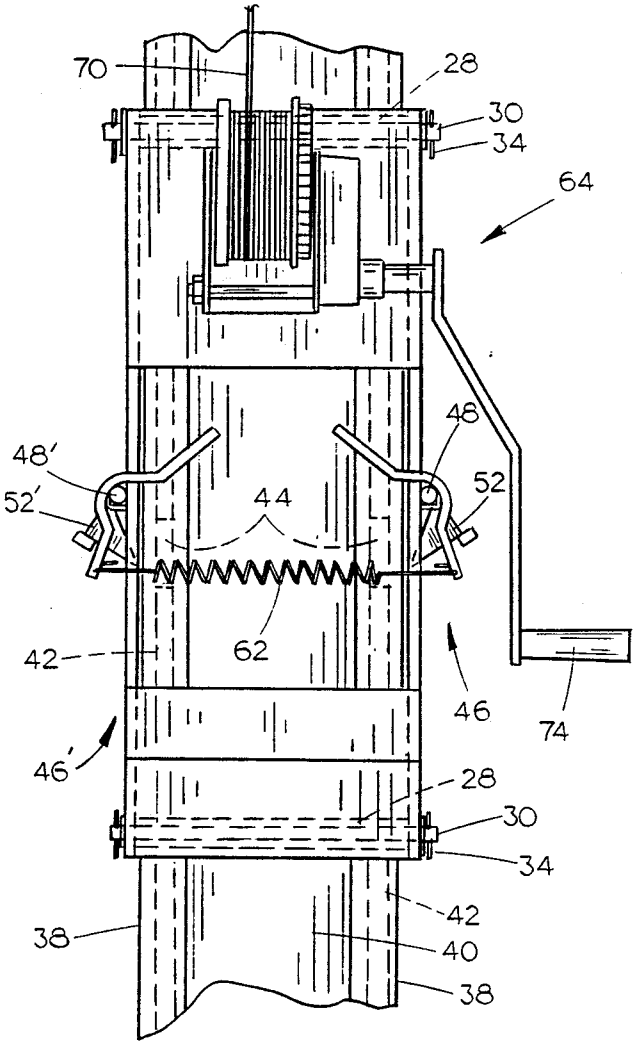
FIG. 5 is a front view of the scaffold jack as the jack is being raised.
Figure 4:
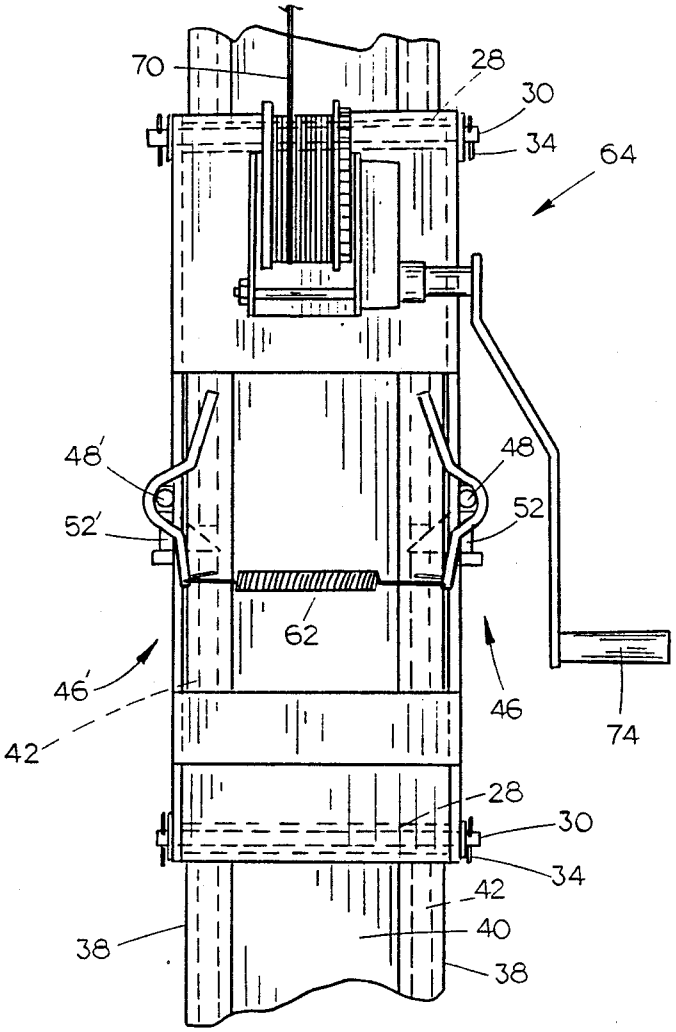
FIG. 4 is a front view of the scaffold jack.

To raise the jack 10, handle 74 on winch 64 is cranked to draw the jack towards upper bracket 76 (as shown in the broken-line drawing in FIG. 3). Because pawls 52 and 52' are triangular in shape, rods 48 and 48' will rotate against the bias of spring 62 and out of apertures 44, allowing the jack to move upwardly in relation to post 14 (see FIG. 5). Once the next higher aperture is reached, spring 62 will bias apexes 54 and 54' into apertures 44 (see FIG. 4) such that jack 10 cannot slide back downwardly on post 14. In order to allow the jack 10 to be moved downwardly on post 14, arms 60 and 60' may be manually moved against the bias of spring 62 to disconnect pawls 52 and 52' from truss joists 38, and handle 74 cranked in the opposite direction.

Figure 6:
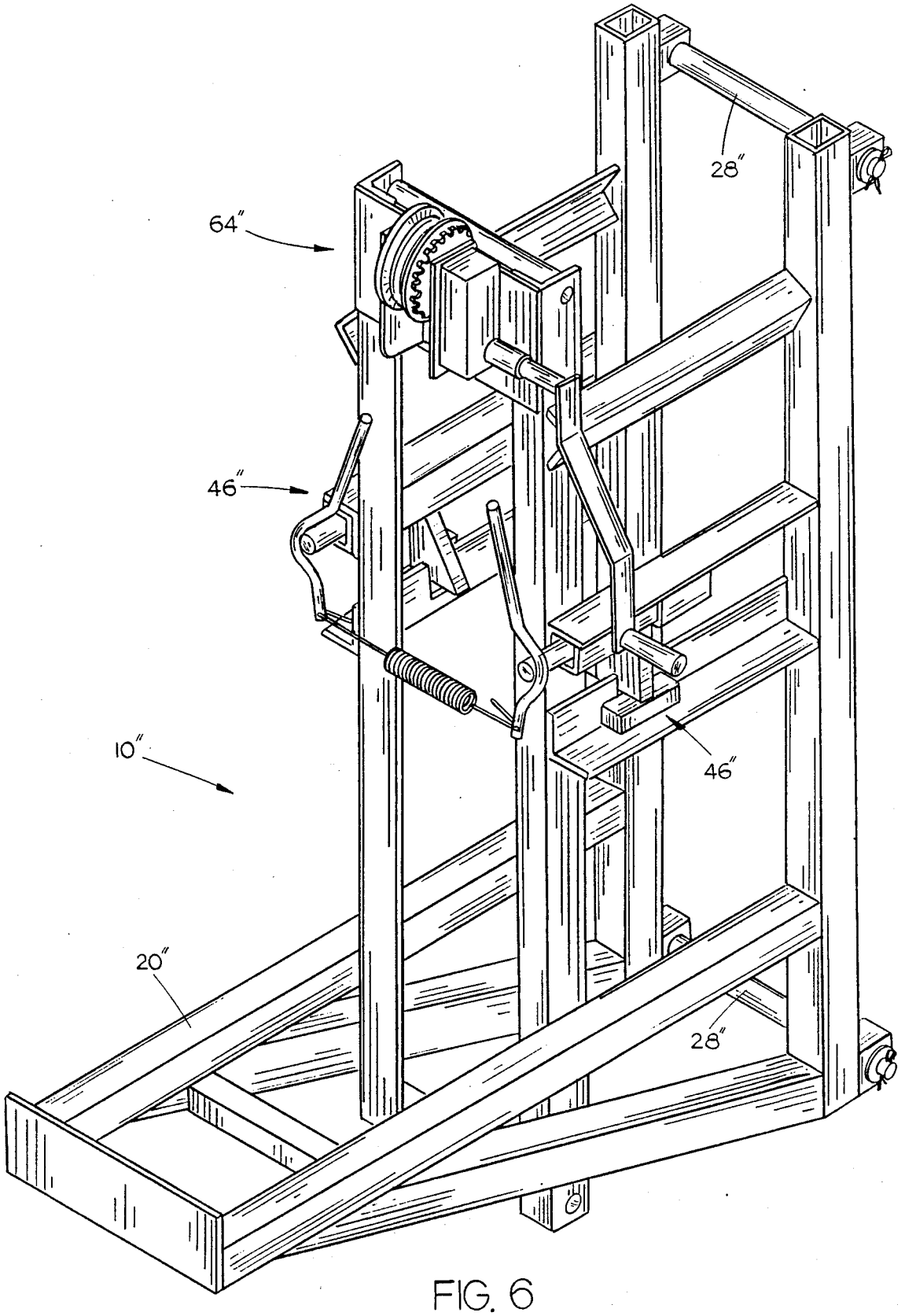
FIG. 6 is a perspective view of a second embodiment of the scaffold jack of this invention.

Whereas the invention has been shown and described in connection with the preferred embodiments thereof, it will be understood that many modification, substitutions and additions may be made which are within the intended broad scope of the appended claims. For example, winch 64 may be motorized and powered such that it is not necessary to have a manually operated handle 74. Likewise, a separate motorized device may be attached to jack 10 which will raise the jack relative to the post, winch 64 serving as an additional safety device. Also, while housing 12 of jack 10 is shown consisting of plates, an open framework of structural members may be utilized equally as well, as shown in FIG. 6 as jack 10'.

Thus, there has been shown and described an improved scaffold jack which accomplishes at least all of the above stated objects.

I claim:

1. In combination:

a vertically oriented post for supporting a jack and a working platform;

said post being formed from a pair of parallel and spaced-apart truss joists having spacers therebetween, each truss joist including a web portion connecting a pair of parallel flange portions;

said post having an upper end and a lower end, and said web portions forming a pair of opposing sides, the sides having a plurality of vertically-spaced and vertically-aligned apertures therein, the apertures in said opposing sides being horizontally aligned to receive a portion of a pawl for supporting a platform above the ground; and a jack for supporting a working platform above the ground, comprising:

a jack housing operably connected to said post for vertical movement thereon; and operable pawl means mounted on said housing, located to correspond with said web apertures in at least one side of said post, and operable for selective journaling in said apertures to prevent downward movement of said housing on said post when said pawl is journaled in an aperture.

2. The combination of claim 1, further comprising a platform means supported on said housing and projecting generally horizontally therefrom, for supporting a person above the ground.

3. The combination of claim 1, wherein said pawl means includes biasing means connected to said pawl means so as to bias said pawl means towards a journaled condition in said apertures.

4. The combination of claim 1 wherein said jack housing includes a pair of opposing side plates, and including first pawl means on one side plate and second pawl means on said opposing side plate, and including biasing means connected between said first and second pawl means, to simultaneously bias said first and second pawl means towards a journaled condition in said apertures.

5. The combination of claim 3, further comprising a release arm connected to each said pawl means, said release arms being independently operable to release said first and second pawl means from their journaled connection with said apertures.

6. The combination of claim 1, further comprising means for moving said housing vertically along said post means, said housing moving means being operably connected between said housing and said post means.

7. The combination of claim 6, wherein said housing moving means includes a winch means mounted on said housing, means for operating said winch, and hook and cable means connecting said winch to said post means, said hook and cable means being removably connected above said housing to said post means.

8. The combination of claim 7, wherein said means for operating said winch is an electrical motor means.

9. The combination of claim 7, further comprising bracket means for receiving said hook and cable means, said bracket means having means for removably connecting said bracket to said post means.

10. The combination of claim 9 wherein said means for removably connecting said bracket to said post means includes a pin removably connected to said bracket and journaled through a pair of said aligned apertures above said housing to support said bracket above said housing.

11. The combination of claim 1, wherein said housing includes a support beam projecting generally horizontally therefrom, for supporting a working platform.

12. The combination of claim 1, further comprising a leg assembly for stabilizing said post means in a generally vertical orientation, said leg assembly including:

first and second leg members, having opposite ends, removably connected to said post means;

means on one end of said first and second leg members for selectively, removably connecting said leg members to said post means;

means on the opposite ends of said first and second leg members for removably connecting said leg members to a vertical structure adjacent and spaced away from said post means, thereby rigidly connecting said post means to an adjacent structure.

13. The combination of claim 12, wherein each said leg members includes a pair of adjustably connected members, such that said leg members are selectively adjustable in length.

14. The combination of claim 12, wherein said means for removably connecting said leg members to said post means includes said post means having an upper end with an aperture therethrough proximal to said upper end, and a pin connected to said leg members and removably journaled through said post aperture.

* * * * *